US010502211B2

(12) United States Patent
Nagahara

(10) Patent No.: US 10,502,211 B2
(45) Date of Patent: Dec. 10, 2019

(54) SCROLL-TYPE COMPRESSOR HAVING INJECTION PASSAGE PART TO ESTABLISH COMMUNICATION BETWEEN AN EXTERNAL INJECTION PIPE AND COMPRESSION CHAMBER, AND RELIEF MECHANISM TO ESTABLISH COMMUNICATION BETWEEN COMPRESSION CHAMBER AND BACK PRESSURE CHAMBER

(71) Applicant: DAIKIN INDUSTRIES, LTD., Osaka-shi, Osaka (JP)

(72) Inventor: Kenji Nagahara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 162 days.

(21) Appl. No.: 15/553,487

(22) PCT Filed: Feb. 29, 2016

(86) PCT No.: PCT/JP2016/055991
§ 371 (c)(1),
(2) Date: Aug. 24, 2017

(87) PCT Pub. No.: WO2016/137002
PCT Pub. Date: Sep. 1, 2016

(65) Prior Publication Data

US 2018/0245593 A1 Aug. 30, 2018

(30) Foreign Application Priority Data

Feb. 27, 2015 (JP) ..... 2015-039610

(51) Int. Cl.
*F03C 2/00* (2006.01)
*F03C 4/00* (2006.01)
(Continued)

(52) U.S. Cl.
CPC ..... *F04C 28/28* (2013.01); *F04C 18/02* (2013.01); *F04C 18/0215* (2013.01);
(Continued)

(58) Field of Classification Search
CPC ..... F04C 28/28; F04C 18/02; F04C 18/0215; F04C 23/008; F04C 2210/26;
(Continued)

(56) References Cited

U.S. PATENT DOCUMENTS 4,669,962 A * 6/1987 Mizuno ..... F04C 18/0215 418/55.5
4,989,414 A * 2/1991 Murayama ..... F04C 28/08 62/228.4
(Continued)

FOREIGN PATENT DOCUMENTS

EP 2 474 741 A2 7/2012
JP 11-107950 A 4/1999
(Continued)

OTHER PUBLICATIONS

International Preliminary Report of corresponding PCT Application No. PCT/JP2016/055991 dated Sep. 8, 2017.
(Continued)

*Primary Examiner* — Theresa Trieu
(74) *Attorney, Agent, or Firm* — Global IP Counselors, LLP

(57) ABSTRACT

A scroll-type compressor includes a compression-chamber-forming member, a housing, an injection passage part, and a relief mechanism. The compression-chamber-forming member forms a compression chamber and has a movable scroll and a fixed scroll. The housing forms a back pressure chamber. Refrigerant to apply back pressure to the compression-chamber-forming member is accumulated in the back pressure chamber. The injection passage part is linked to the
(Continued)

compression chamber. The relief mechanism is configured to establish a communication between the compression chamber and the back pressure chamber communicating when injection pressure of the refrigerant flowing from the injection passage part into the compression chamber is higher than the pressure in the back pressure chamber.

18 Claims, 11 Drawing Sheets

(51) Int. Cl.
*F04C 18/00* (2006.01)
*F04C 28/28* (2006.01)
*F04C 18/02* (2006.01)

(52) U.S. Cl.
CPC ..... *F04C 2210/26* (2013.01); *F04C 2240/10* (2013.01); *F04C 2240/20* (2013.01); *F04C 2240/30* (2013.01); *F04C 2270/215* (2013.01); *F04C 2270/42* (2013.01)

(58) Field of Classification Search
CPC ..... F04C 2240/10; F04C 2240/20; F04C 2240/30; F04C 2270/42; F04C 2270/215
USPC ..... 418/55.1–55.6, 57, 180
See application file for complete search history.

(56) References Cited

U.S. PATENT DOCUMENTS

| | | | | |
|---|---|---|---|---|
| 5,110,268 | A * | 5/1992 | Sakurai | F04C 18/0215 418/55.6 |
| 2010/0212352 | A1* | 8/2010 | Kim | F04C 18/0215 418/55.5 |
| 2013/0189144 | A1 | 7/2013 | Yamamoto et al. | |

FOREIGN PATENT DOCUMENTS

| | | | |
|---|---|---|---|
| JP | 2009-257287 | A | 11/2009 |
| JP | 2012-57625 | A | 3/2012 |
| JP | 2012-117519 | A | 6/2012 |
| JP | 2014-125914 | A | 7/2014 |

OTHER PUBLICATIONS

International Search Report of corresponding PCT Application No. PCT/JP2016/055991 dated May 24, 2016.
European Search Report of corresponding EP Application No. 16 75 5746.1 dated Jan. 2, 2018.
Notification of Reasons for Refusal of corresponding JP Application No. 2016-036458 dated May 24, 2016.

* cited by examiner

SCROLL-TYPE COMPRESSOR HAVING INJECTION PASSAGE PART TO ESTABLISH COMMUNICATION BETWEEN AN EXTERNAL INJECTION PIPE AND COMPRESSION CHAMBER, AND RELIEF MECHANISM TO ESTABLISH COMMUNICATION BETWEEN COMPRESSION CHAMBER AND BACK PRESSURE CHAMBER

CROSS-REFERENCE TO RELATED APPLICATIONS

This U.S. National stage application claims priority under 35 U.S.C. § 119(a) to Japanese Patent Application No. 2015-039610, filed in Japan on Feb. 27, 2015, the entire contents of which are hereby incorporated herein by reference.

TECHNICAL FIELD

The present invention relates to a scroll-type compressor.

BACKGROUND ART

Conventionally, there are known scroll-type compressors in which a compression chamber is formed by compression-chamber-forming members such as a fixed scroll and a movable scroll. For example, there have been scroll-type compressors in which a refrigerant gas at intermediate pressure in a refrigeration cycle is injected into the compression chamber, whereby the operating efficiency of an air conditioner is improved (see, e.g., Japanese Laid-open Patent Publication No. H11-107950). There have been scroll-type compressors in which a back pressure chamber is provided to a rear-surface side of the movable scroll, and overturning of the movable scroll is suppressed by applying a pressing force in a direction opposite a thrust-direction gas load in a compression chamber (see, e.g., Japanese Laid-open Patent Publication No. 2012-117519).

SUMMARY

Technical Problem

In scroll-type compressors, when refrigerant is injected into the compression chamber, overturning (also referred to as tipping) of the movable scroll could occur due to an increase in pressure within the compression chamber due to the injection.

If the movable scroll is overturned, a gap in the thrust surface between the fixed scroll and the movable scroll widens. When this occurs, refrigerant in the back pressure chamber could leak through the gap to an inflow side (low-pressure side) of a compression mechanism, even if fluid in the compression chamber is supplied to the back pressure chamber, as disclosed in Japanese Laid-open Patent Publication No. 2012-117519. Therefore, it becomes impossible for the pressure in the back pressure chamber to increase, and it becomes difficult to reverse the overturning of the movable scroll.

Additionally, if the movable scroll is overturned, a gap is formed between respective lap surfaces of each of the scrolls and respective panels that face the laps. Therefore, within the compression chamber, comparatively high-pressure refrigerant near the discharge port could leak through such gaps to near the intake port. When this occurs, the comparatively high-pressure refrigerant in the compression chamber is excessively compressed, and the pressure in the compression chamber increases higher than during normal operations. Therefore, a force separating the movable scroll from the fixed scroll increases, making it difficult to reverse the overturning of the movable scroll.

An object of the present invention is to provide a scroll-type compressor in which it is possible to suppress overturning of a compression-chamber-forming member.

Solution to Problem

A scroll-type compressor according to a first aspect of the present invention includes a fixed scroll, a movable scroll, a housing, an injection passage part, and a relief mechanism. The movable scroll is coupled with the fixed scroll to form a compression chamber. The housing forms a back pressure chamber in which refrigerant for applying back pressure to the movable scroll is accumulated. The injection passage part is provided to the fixed scroll, an external injection pipe and the compression chamber communicating via the injection passage part. The relief mechanism is provided to the fixed scroll, the compression chamber and the back pressure chamber communicating via the relief mechanism when the injection pressure, which is the pressure of the refrigerant flowing from the injection passage part into the compression chamber, is greater than the pressure in the back pressure chamber.

In this scroll-type compressor, even when the refrigerant is injected into the compression chamber, the compression chamber and the back pressure chamber communicate via the relief mechanism when the injection pressure is greater than the pressure in the back pressure chamber, therefore making it possible to quickly increase the pressure in the back pressure chamber. This makes it possible to suppress overturning of the movable scroll.

A scroll-type compressor according to a second aspect of the present invention includes a compression-chamber-forming member, a housing, an injection passage part, and a relief mechanism. The compression-chamber-forming member forms a compression chamber. The housing forms a back pressure chamber in which the refrigerant for applying back pressure to the compression-chamber-forming member is accumulated. The injection passage part is formed in the compression-chamber-forming member and/or other surrounding members, and is linked to the compression chamber. The relief mechanism is provided to the compression-chamber-forming member, the compression chamber and the back pressure chamber communicating via the relief mechanism when injection pressure, which is the pressure of the refrigerant flowing from the injection passage part into the compression chamber, is greater than the pressure in the back pressure chamber.

In this scroll-type compressor, even when the refrigerant is injected into the compression chamber, the compression chamber and the back pressure chamber communicate via the relief mechanism when the injection pressure is greater than the pressure in the back pressure chamber, therefore making it possible to quickly increase the pressure in the back pressure chamber. This makes it possible to suppress overturning of a movable scroll or other compression-chamber-forming member.

A scroll-type compressor according to a third aspect of the present invention is the scroll-type compressor according to the first or second aspect, wherein the compression-chamber-forming member has the movable scroll and the fixed scroll. The relief mechanism is provided with a relief passage part and a check valve. The relief passage part is provided to the fixed scroll, the compression chamber and the back pressure chamber communicating via the relief passage part. The check valve is associated with the relief passage part.

In this scroll-type compressor, the check valve prevents the communication between the compression chamber and the back pressure chamber when the injection pressure is lower than the pressure in the back pressure chamber, therefore making it possible to prevent a reduction in pressure in the back pressure chamber.

A scroll-type compressor according to a fourth aspect of the present invention is the scroll-type compressor according to the third aspect, wherein the fixed scroll includes a fixed-side panel part and a fixed-side outer edge part. The injection passage part is provided to at least the fixed-side panel part. The relief passage part is provided to the fixed-side outer edge part.

In this scroll-type compressor, because the configuration described above is provided, refrigerant gas can be introduced into the compression chamber in accordance with an orbiting operation of the movable scroll.

A scroll-type compressor according to a fifth aspect of the present invention is the scroll-type compressor according to any one of the first to fourth aspects, wherein the scroll-type compressor includes an introduction mechanism for introducing the refrigerant in the compression chamber into the back pressure chamber over a first period when the pressure in the compression chamber is higher than the pressure in the back pressure chamber. The relief mechanism introduces the refrigerant in the compression chamber into the back pressure chamber over a second period, which includes a timing earlier than the first period.

In this scroll-type compressor, the refrigerant is introduced into the back pressure chamber over the second period at a timing earlier than the first period, therefore making it possible to quickly increase the pressure in the back pressure chamber via the relief mechanism.

A scroll-type compressor according to a sixth aspect of the present invention is the scroll-type compressor according to the fifth aspect, wherein a configuration is adopted such that part of the second period overlaps part of the first period.

In this scroll-type compressor, comparatively high-pressure fluid can be supplied to the back pressure chamber over a long period of time. As a result, overturning of the movable scroll can be further suppressed.

A scroll-type compressor according to a seventh aspect of the present invention is the scroll-type compressor according to the fifth or sixth aspect, wherein the scroll-type compressor further includes an injection mechanism for introducing the refrigerant from the injection passage part into the compression chamber over a third period. A configuration is adopted such that the third period does not overlap the first period.

In this scroll-type compressor, the third period, in which the refrigerant is introduced from the injection passage part into the compression chamber, does not overlap the first period, therefore making it possible to stabilize the back pressure chamber at a desired pressure.

A scroll-type compressor according to an eighth aspect of the present invention is the scroll-type compressor according to the seventh aspect, wherein a configuration is adopted such that the third period is included in the second period.

In this scroll-type compressor, because the configuration described above is provided, the pressure in the back pressure chamber can be quickly increased from a point in time when the refrigerant has been introduced from the injection passage part into the compression chamber, even when there is a risk of overturning.

A scroll-type compressor according to a ninth aspect of the present invention is the scroll-type compressor according to any one of the fifth to eighth aspects, wherein the compression-chamber-forming member has the movable scroll and the fixed scroll. The introduction mechanism is provided with a fixed-side passage part and a movable-side passage part. The fixed-side passage part is formed in the fixed scroll, the fixed-side passage part communicating from the compression chamber to an opening end. The movable-side passage part is formed in the movable scroll, the compression chamber and the back pressure chamber communicating, by connection of the fixed-side passage part, in accordance with the orbiting operation of the movable scroll.

In this scroll-type compressor, the compression chamber and the back pressure chamber communicate by connection to the fixed-side passage part in accordance with the orbiting operation of the movable scroll, therefore making it possible to easily introduce the refrigerant into the back pressure chamber.

A scroll-type compressor according to a tenth aspect of the present invention is the scroll-type compressor according to the ninth aspect, wherein the introduction mechanism is configured such that the second period ends before the point in time when a connection area of the fixed-side passage part and the movable-side passage part is maximized.

In this scroll-type compressor, the introduction of refrigerant into the back pressure chamber by the relief mechanism ends earlier than the introduction of refrigerant into the back pressure chamber by the introduction mechanism, therefore making it possible to stabilize the back pressure chamber at a desired pressure.

A scroll-type compressor according to an eleventh aspect of the present invention is the scroll-type compressor according to any one of the fifth to tenth aspects, wherein the relief mechanism is provided on the low-pressure side of the compression chamber compared with the introduction mechanism.

In this scroll-type compressor, it is possible to stabilize the back pressure chamber at a desired pressure during normal operation of the compressor.

Advantageous Effects of Invention

In the scroll-type compressor according to the present invention, when refrigerant is injected into a compression chamber, the compression chamber and a back pressure chamber communicate via a relief mechanism when the injection pressure is greater than the pressure in the back pressure chamber; therefore, it is possible to quickly increase the pressure in the back pressure chamber. This makes it possible to suppress overturning of a movable scroll or other compression-chamber-forming member.

DESCRIPTION OF EMBODIMENTS (1) Overall Configuration

A scroll-type compressor 10 according to an embodiment of the present invention shall now be described with reference to the drawings. The scroll-type compressor 10 according to the embodiment described below is one example of a compressor of the present invention; modifications may be made, as appropriate, within a range that does not go beyond the gist of the present invention.

Figure 1:
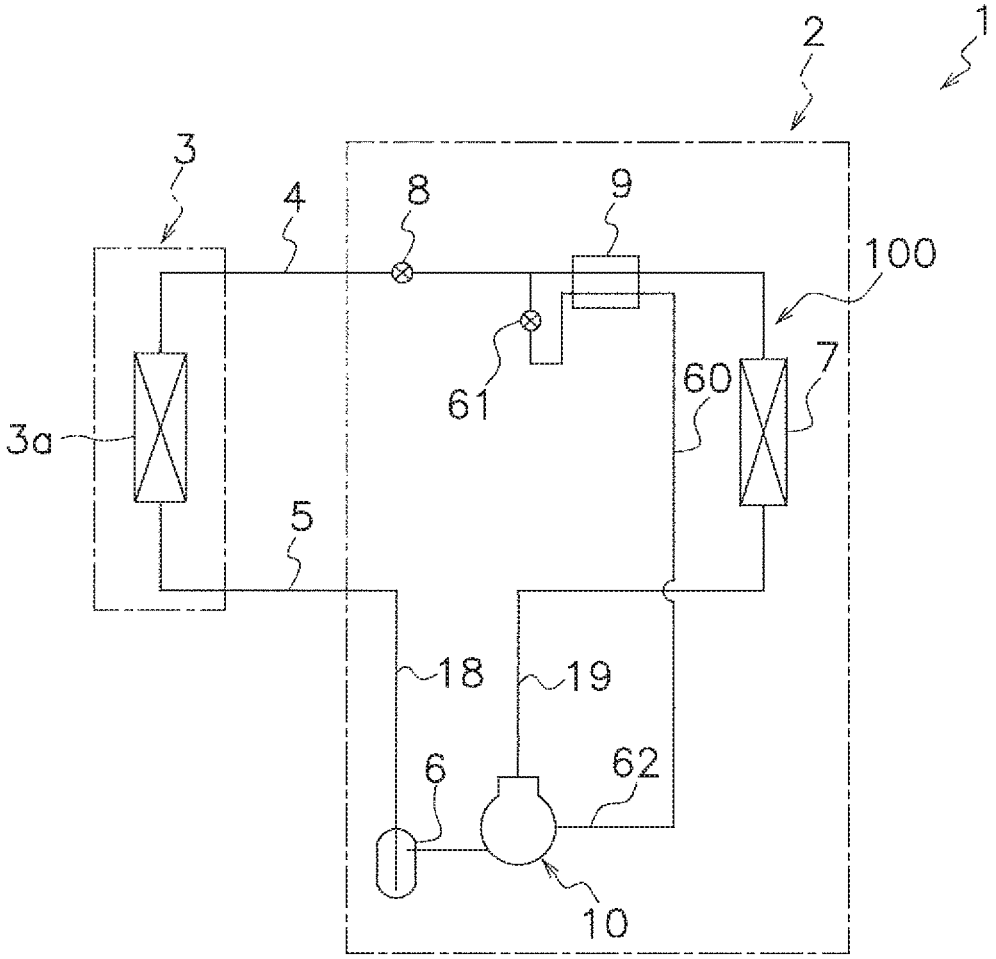
FIG. 1 is a schematic diagram illustrating the configuration of an air conditioner 1.

FIG. 1 is a schematic diagram illustrating the configuration of an air conditioner 1 in which the scroll-type compressor 10 is used. The scroll-type compressor 10 according to one embodiment of the present invention is a compressor used in various refrigerating device. Here, the scroll-type compressor 10 is configured to be used in the air conditioner 1.

The air conditioner 1 is an air conditioner exclusively for cooling operation. However, no limitation is provided thereby; air conditioners using the scroll-type compressor 10 may be air conditioners exclusively for heating operation, or may be air conditioners capable of both cooling operation and heating operation. The air conditioner 1 principally has an outdoor unit 2 having the scroll-type compressor 10; an indoor unit 3; and a liquid refrigerant communication pipe 4 and a gas refrigerant communication pipe 5 that connect the outdoor unit 2 and the indoor unit 3. The air conditioner 1 has a paired design as in FIG. 1; the air conditioner 1 has one each of the outdoor unit 2 and the indoor unit 3. However, no limitation is provided thereby; the air conditioner 1 may be a multiple-unit design having a plurality of indoor units 3. In the air conditioner 1, the scroll-type compressor 10, and an indoor heat exchanger 3*a*, an outdoor heat exchanger 7, an expansion valve 8, and other constituent equipment are connected by a pipe, to constitute the refrigerant circuit 100 (see FIG. 1).

The indoor unit 3 principally has the indoor heat exchanger 3*a*, as indicated in FIG. 1. The indoor heat exchanger 3*a*, for example, is a fin-and-tube type heat exchanger with a cross-fin design, configured from a heat transfer tube and multiple heat transfer fins. The liquid side of the indoor heat exchanger 3*a* is connected to the liquid refrigerant communication pipe 4, and the gas side of the indoor exchanger is connected to the gas refrigerant communication pipe 5. The indoor heat exchanger 3*a* functions as a refrigerant evaporator. In other words, the indoor heat exchanger 3*a* receives a supply of low-temperature liquid refrigerant from the outdoor unit 2 through the liquid refrigerant communication pipe 4, and cools the indoor air. The refrigerant which has passed through the indoor heat exchanger 3*a* returns to the outdoor unit 2 through the gas refrigerant communication pipe 5.

As indicated in FIG. 1, the outdoor unit 2 principally has an accumulator 6; the scroll-type compressor 10; the outdoor heat exchanger 7; the expansion valve 8; an economizer heat exchanger 9; and an injection valve 61. These devices are connected by refrigerant pipes, as shown in FIG. 1.

The accumulator 6 is provided on a pipe that connects the gas refrigerant communication pipe 5 and an intake tube 18 of the scroll compressor 10. The accumulator 6 separates the refrigerant, which has flowed from the indoor heat exchanger 3*a* into the intake tube 18 through the gas refrigerant communication pipe 5, into the gas phase and the liquid phase in order to prevent the supply of liquid refrigerant to the scroll-type compressor 10. The gas-phase refrigerant that is collected in the upper space of the accumulator 6 is supplied to the scroll-type compressor 10.

The scroll-type compressor 10 compresses the refrigerant that has been taken in through the intake tube 18 in a compression chamber 31 and discharges the compressed refrigerant from a discharge tube 19. In the scroll-type compressor 10, "intermediate injection" is performed, in which a portion of refrigerant flowing from the outdoor heat exchanger 7 toward the expansion valve 8 is supplied to the compression chamber 31 midway in compression. The scroll-type compressor 10 is described below.

The outdoor heat exchanger 7, for example, is a fin-and-tube type heat exchanger with a cross-fin design, configured from a heat transfer tube and multiple heat transfer fins. One end of the outdoor heat exchanger 7 is connected to the side of the discharge tube 19 in which flows refrigerant discharged from the scroll-type compressor 10, and the other end of the outdoor heat exchanger 7 is connected to the side of the liquid refrigerant communication pipe 4. The outdoor heat exchanger 7 functions as a condenser of gas refrigerant supplied from the scroll-type compressor 10 through the discharge tube 19.

The expansion valve 8 is provided on a pipe that connects the outdoor heat exchanger 7 and the liquid refrigerant communication pipe 4. The expansion valve 8 is a motorized valve, the valve opening of which can be adjusted to regulate the pressure and flow rate of refrigerant flowing in pipeline.

The economizer heat exchanger 9 is disposed between the outdoor heat exchanger 7 and the expansion valve 8, as shown in FIG. 1. The economizer heat exchanger 9 is a heat exchanger that performs heat exchange between the refrigerant flowing from the outdoor heat exchanger 7 toward the expansion valve 8, and the refrigerant, depressurized by the injection valve 61, flowing in an injection refrigerant supply tube 60.

The injection valve 61 is a motorized valve capable of adjusting the valve opening in order to regulate the pressure and flow rate of refrigerant injected into the scroll-type compressor 10. The injection valve 61 is provided in the injection refrigerant supply tube 60 that branches from the pipeline connecting the outdoor heat exchanger 7 and the expansion valve 8. The injection refrigerant supply tube 60 is piping that supplies the refrigerant to an injection pipe 62 of the scroll-type compressor 10.

(2) Detailed Description of the Scroll-Type Compressor

Figure 2:
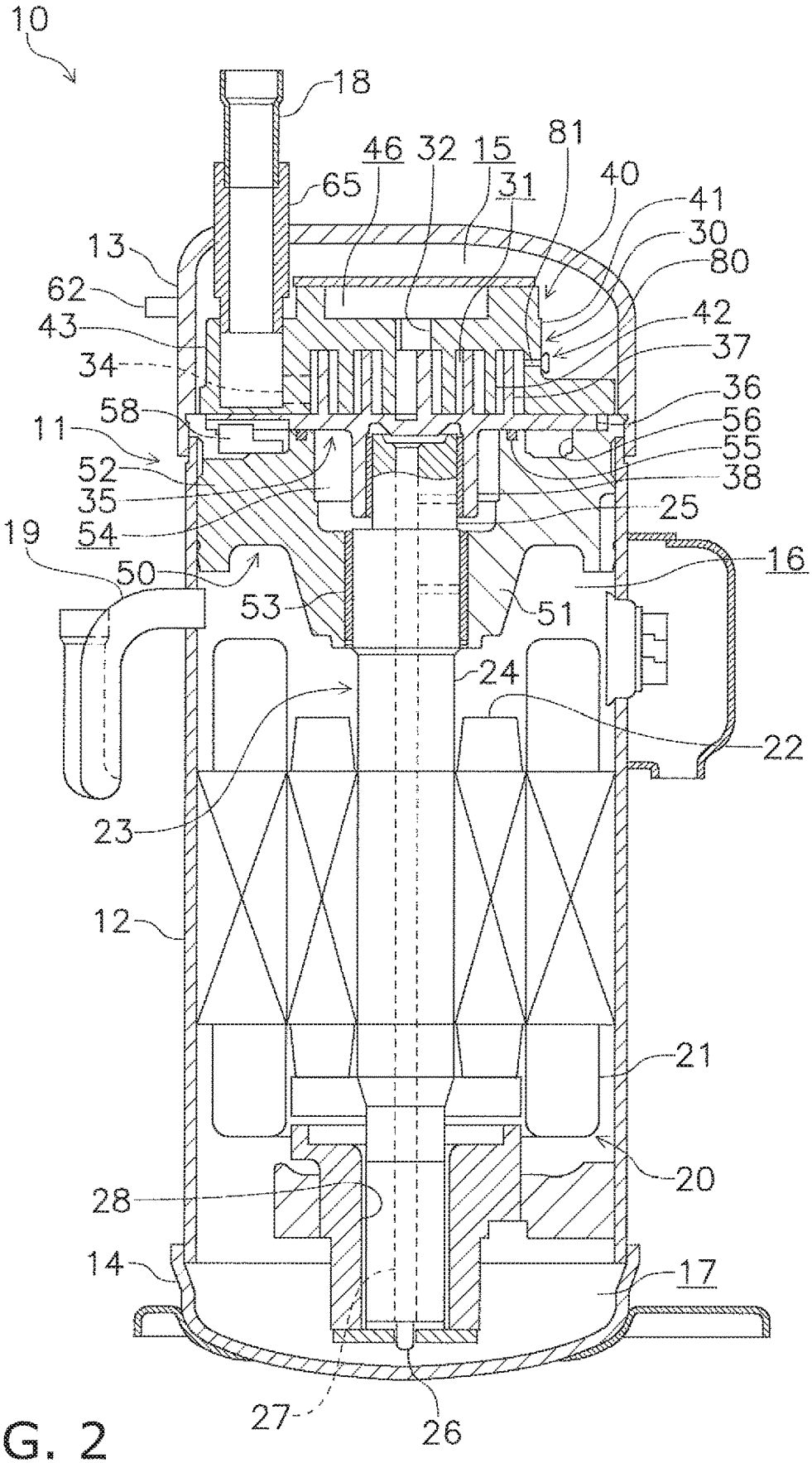
FIG. 2 is a schematic diagram illustrating the configuration of a scroll-type compressor 10 in a vertical cross-section.
Figure 3:
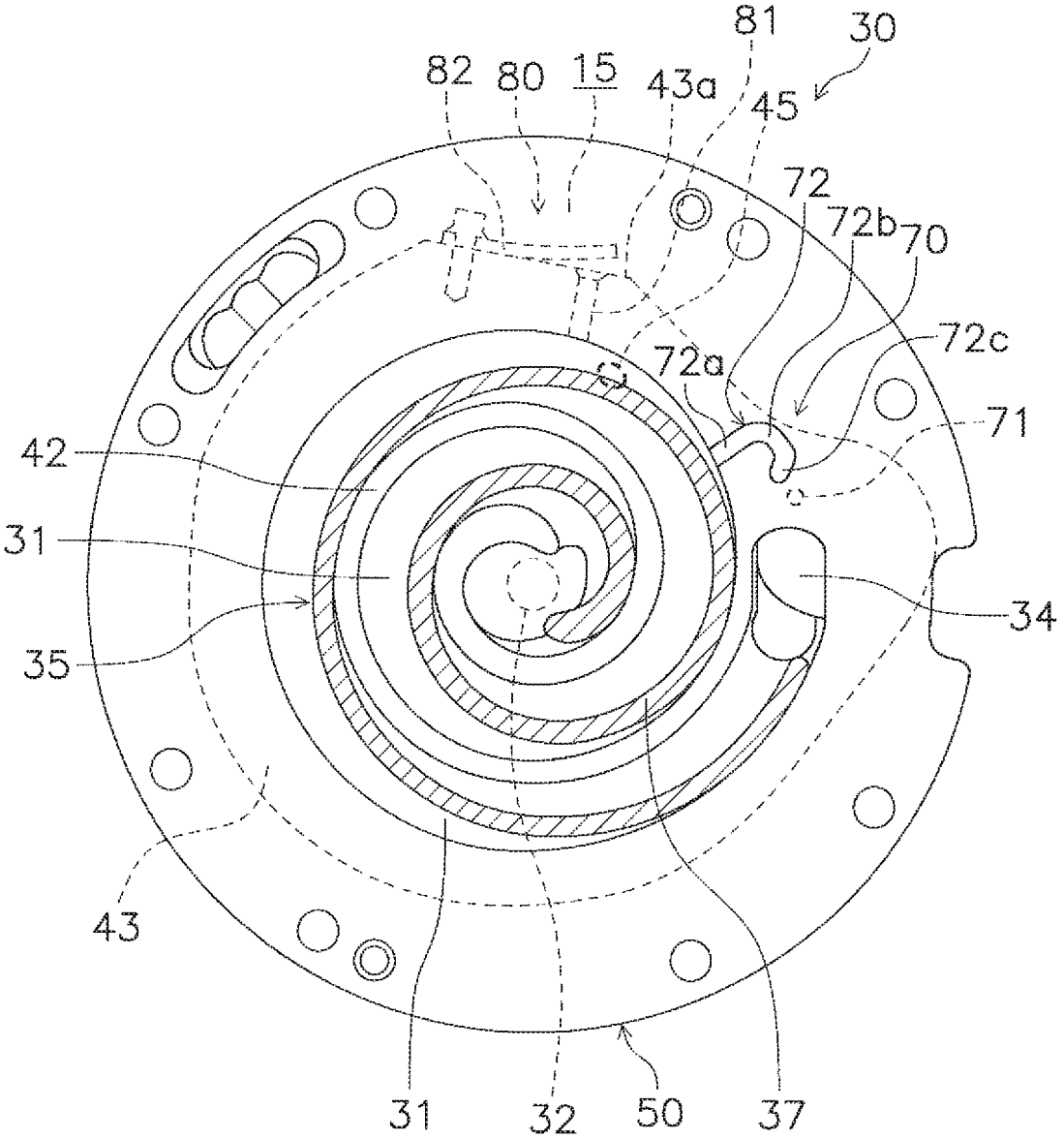
FIG. 3 is a schematic diagram illustrating the configuration of the scroll-type compressor 10 in a horizontal cross-section.

FIGS. 2 and 3 are schematic diagrams illustrating the configuration of the scroll-type compressor 10. FIG. 2 schematically shows the configuration in a vertical cross-section at a position at which an auxiliary introduction mechanism 80 of the scroll-type compressor 10 is provided. FIG. 3 schematically shows the configuration in a horizontal cross-section at a position at which a compression mechanism 30 of the scroll-type compressor 10 is provided.

The scroll-type compressor 10 is provided with a casing 11, a housing 50 accommodated in the casing 11, an electric motor 20, and the compression mechanism 30.

(2-1) Casing (2-1-1) Principal Configuration of Casing

The casing 11 is configured from a vertically long cylindrical airtight container. The casing 11 is provided with a cylindrical barrel part 12 of which both axial-direction ends are open, an upper panel 13 for closing off the upper end part of the barrel part 12, and a lower panel 14 for closing off the lower end part of the barrel part 12. The interior space of the casing 11 is vertically divided by the housing 50. Inside the casing 11, the space above the housing 50 constitutes an upper space 15, and the space below the housing 50 constitutes a lower space 16. In the lower space 16, an oil reservoir part 17 is formed at the bottom of the casing 11. Lubricant oil for lubricating the sliding portions of bearings and/or the compression mechanism 30 is accumulated in the oil reservoir part 17.

The intake tube 18, the discharge tube 19, and the injection pipe 62 are attached to the casing 11. The intake tube 18 passes through the upper part of the upper panel 13. The outflow end part of the intake tube 18 is connected to an intake tube coupling 65 of the compression mechanism 30. The discharge tube 19 passes through the barrel part 12. The inflow end part of the discharge tube 19 opens to the lower space 16. The injection pipe 62 passes through the upper panel 13.

(2-1-2) Injection Pipe

The injection pipe 62 is provided so as to pass through the upper panel 13 of the casing 11. The end part of the injection pipe 62 on the outside of the casing 11 is connected to the injection refrigerant supply tube 60. The end part of the injection pipe 62 on the inside of the casing 11 is provided with a check valve 62*a*. The injection pipe 62 supplies the refrigerant to an injection passage 44 formed in the fixed scroll 40. The injection passage 44 communicates with the compression chamber 31 of the compression mechanism 30, and the refrigerant supplied from the injection pipe 62 is supplied to the compression chamber 31 through the injection passage 44. The refrigerant at a pressure intermediate between the low pressure and the high pressure of the refrigeration cycle (an intermediate pressure) is supplied from the injection pipe 62 to the injection passage 44.

(2-2) Housing (2-2-1) Principal Configuration of Housing

The housing 50 is fixed to the upper end part of the barrel part 12 of the casing 11. The housing 50 is formed in a substantially cylindrical shape, and has a main shaft part 24 passing through the interior thereof. The housing 50 has a small-diameter part 51 formed around an upper bearing part 53, and a large-diameter part 52 formed around an eccentric part 25. The outer peripheral surface of the large-diameter part 52 is fixed to the casing 11. A substantially cylindrical high-pressure-side back pressure chamber 54 is formed inside the large-diameter part 52. High-pressure lubricant oil that has flowed out from an oil feed passage 27 is supplied to the high-pressure-side back pressure chamber 54. The high-pressure-side back pressure chamber 54 is configured to have the same pressure atmosphere as discharge refrigerant of the compression mechanism 30. An annular seal ring 55 is provided to the upper end of the inner peripheral edge part of the large-diameter part 52 of the housing 50. The seal ring 55 partitions the high-pressure-side back pressure chamber 54 and an intermediate-pressure-side back pressure chamber 56 in an airtight manner. The high-pressure-side back pressure chamber 54 is divided on the inner peripheral side of the seal ring 55, and the intermediate-pressure-side back pressure chamber 56 is divided on the outer-peripheral side of the seal ring 55.

(2-2-2) Intermediate-Pressure-Side Back Pressure Chamber

A substantially annular recess is formed in the upper end surface of the large-diameter part 52 of the housing 50, and the intermediate-pressure-side back pressure chamber 56 is formed within the recess. The intermediate-pressure refrigerant in the compression chamber 31 is supplied to the intermediate-pressure-side back pressure chamber 56. The intermediate-pressure-side back pressure chamber 56 also communicates with the upper space 15 via a communication passage (not shown). Specifically, the intermediate-pressure-side back pressure chamber 56 and the upper space 15 are configured to have substantially the same pressure atmosphere. Essentially, the intermediate-pressure-side back pressure chamber 56 is configured such that the refrigerant for applying pressure from the opposite side to the fixed scroll 40 relative to the movable scroll 35 is accumulated.

(2-3) Electric Motor 20

The electric motor 20 is accommodated in the lower space 16. The electric motor 20 has a stator 21 and a rotor 22. The stator 21 is formed in a cylindrical shape, and the outer peripheral surface thereof is fixed to the barrel part 12 of the casing 11. The rotor 22 is formed in a cylindrical shape, and is inserted into the stator 21. A drive shaft 23 that passes through the rotor 22 is fixed inside the rotor 22. The drive shaft 23 connects the electric motor 20 and the compression mechanism 30. The drive shaft 23 has the main shaft part 24, and the eccentric part 25, which is formed integrally with the upper side of the main shaft part 24. The eccentric part 25 is smaller in diameter than the main shaft part 24, and is eccentric with respect to the axis of the main shaft part 24 by a prescribed amount. The main shaft part 24 is rotatably supported by a lower bearing part 28 and the upper bearing part 53. The lower end part of the drive shaft 23 is provided with an oil feed pump 26. An intake port of the oil feed pump 26 opens to the oil reservoir part 17. The lubricant oil drawn up by the oil feed pump 26 is supplied to the sliding portions of the bearings 28, 53 and/or the compression mechanism 30 via the oil feed passage 27 inside the drive shaft 23.

(2-4) Compression Mechanism

The compression mechanism 30 is disposed above the housing 50. The compression mechanism 30 is a scroll-type rotating compression mechanism having a compression-chamber-forming member such as the fixed scroll 40 and the movable scroll 35. In the compression mechanism 30, the compression chamber 31 is formed by the compression-chamber-forming member. Specifically, the compression chamber 31 is thrilled between the fixed scroll 40 and the movable scroll 35. The fixed scroll 40 is fastened to the housing 50 by bolts. The movable scroll 35 is turnably accommodated between the fixed scroll 40 and the housing 50. The compression mechanism 30 is also provided with an introduction mechanism 70 and the auxiliary introduction mechanism 80 for supplying the refrigerant from the compression chamber 31 to the intermediate-pressure-side back pressure chamber 56, as shall be described later.

(2-4-1) Fixed Scroll

The fixed scroll 40 has a substantially discoid fixed-side panel part 41, a fixed-side lap 42 supported by the lower surface of the fixed-side panel part 41, and an outer edge part 43 formed on the radially outer side of the fixed-side lap 42.

A discharge port 32 is formed in the central portion of the fixed-side panel part 41. The discharge port 32 passes vertically through the fixed-side panel part 41. A discharge chamber 46 is divided on the upper side of the discharge port 32. The discharge chamber 46 communicates with the lower space 16 via a discharge passage (not shown). Specifically, the lower space 16 is configured to have the same pressure atmosphere as the pressure of discharge refrigerant of the compression mechanism 30. The fixed-side lap 42 is formed so as to extend in a spiral shape from the discharge port 32 to the outer edge part 43 (see FIG. 3). The fixed-side panel part 41 also has formed therein the injection passage 44, the external injection pipe 62 and the compression chamber 31 communicating via the injection passage 44.

Figure 4:
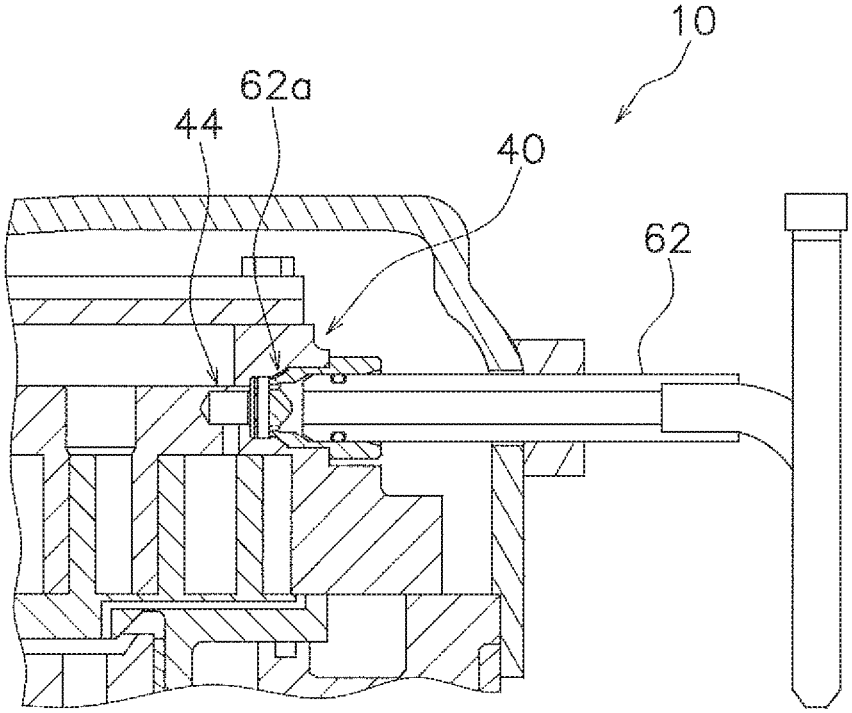
FIG. 4 is a schematic diagram illustrating a part of the scroll-type compressor 10 in a vertical cross-section.

The injection passage 44 is configured from a through-hole passing axially through the fixed-side panel part 41, as is schematically shown by the configuration in vertical cross-section in FIG. 4. When the movable scroll 35 performs the orbiting operation, an injection port 45 that is an outflow port of the injection passage 44 to the compression chamber 31 opens and closes. The intermediate injection of refrigerant to the compression chamber 31 is thereby performed. The refrigerant is introduced from the injection pipe 62 to the compression chamber 31 over a "third period" via the injection passage 44. When the check valve 62*a* is provided to the injection passage 44 and the pressure inside the compression chamber 31 is greater than the pressure in the injection pipe 62, the refrigerant is prevented from flowing back from the compression chamber 31 to the injection pipe 62.

An intake port 34 is formed in the outer edge part 43 of the fixed scroll 40. The intake port 34 is connected to the outflow part of the intake tube 18.

The injection passage 44 may be formed by a constituent member of the fixed scroll 40, or may be formed using also a separate member. Specifically, a configuration may be adopted such that one end of the injection pipe 62 is connected to the fixed-side panel part 41, or a configuration may be adopted such that a head member 90 is fixed to the fixed-side panel part 41 and one end of the injection pipe 62 is connected to the head member 90 (see FIG. 10). In such a case, the intermediate-pressure refrigerant flowing from the injection pipe 62 is injected into the compression chamber 31 through a passage formed inside the head member 90 and the fixed scroll 40. Furthermore, as another form, a configuration may be adopted such that one end of the injection pipe 62 is connected to the housing 50 (see FIG. 11). In such a case, the intermediate-pressure refrigerant flowing from the injection pipe 62 is injected into the compression chamber 31 through a passage formed inside the housing 50 and the fixed scroll.

(2-4-2) Movable Scroll

The movable scroll 35 has a substantially discoid movable-side panel part 36, a movable-side lap 37 supported by the upper surface of the movable-side panel part 36, and a boss part 38 supported by the lower surface of the movable-side panel part 36.

The movable-side panel part 36 is supported by the housing 50 via an Oldham coupling 58. The movable-side lap 37 is formed so as to extend in a spiral shape from near the center of the movable-side panel part 36 to the outer edge part 43 of the fixed scroll 40. The boss part 38 is formed in a cylindrical shape of which the lower side is open, the eccentric part 25 being inserted into the interior thereof.

(2-4-3) Introduction Mechanism

Figure 5:
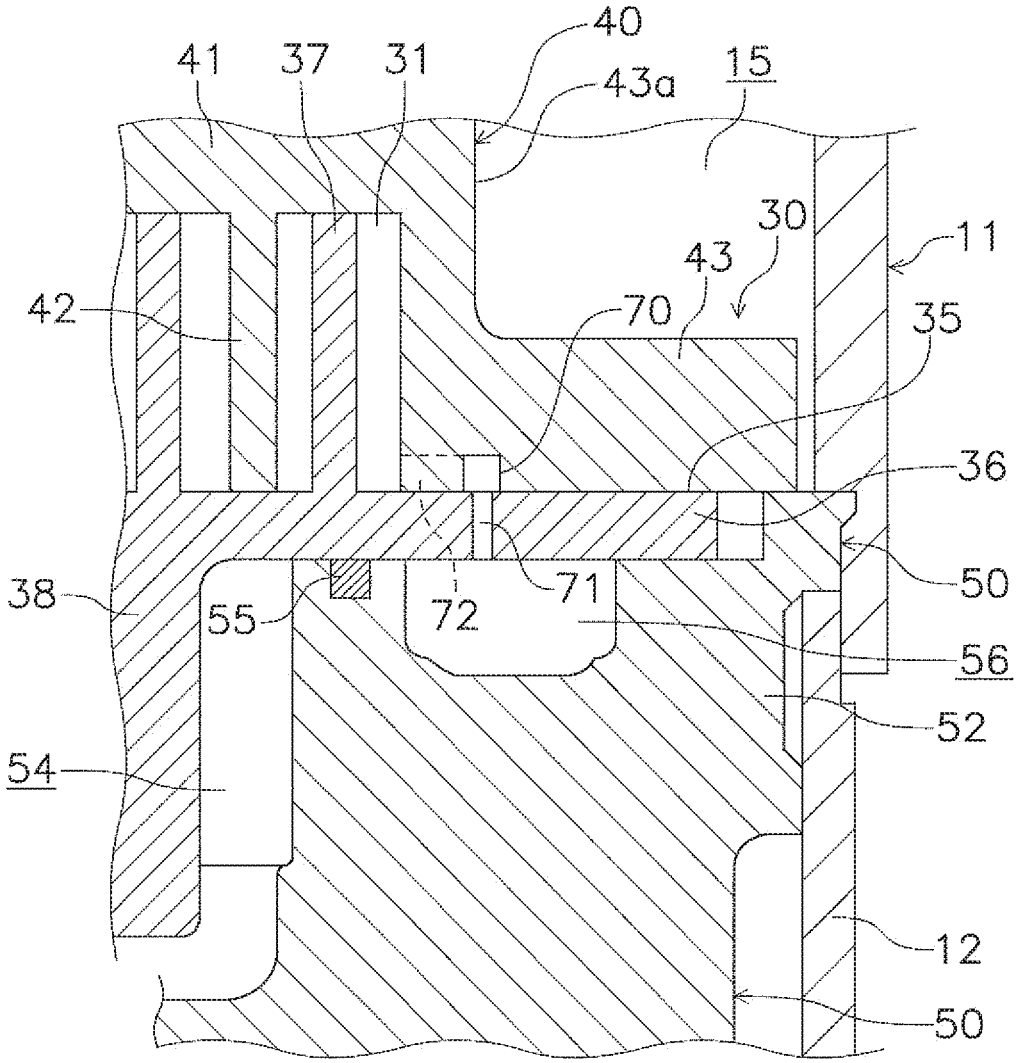
FIG. 5 is a schematic diagram illustrating a part of the scroll-type compressor 10 in a vertical cross-section.

The introduction mechanism 70 has a movable-side vertical hole 71 and a fixed-side communicating groove 72, as is schematically shown by the configuration in vertical cross-section in FIG. 5.

The movable-side vertical hole 71 (movable-side passage part) is configured from a through-hole passing axially through the movable-side panel part 36 of the movable scroll 35. The movable-side vertical hole 71 is formed in a long and narrow columnar shape. When the movable scroll 35 performs the orbiting operation, the movable-side vertical hole 71 is correspondingly displaced at the same turning radius. The turn trajectory of the movable-side vertical hole 71 overlaps the intermediate-pressure-side back pressure chamber 56 in the axial direction. The movable-side vertical hole 71 constantly communicates with the intermediate-pressure-side back pressure chamber 56 at any orbiting position.

The fixed-side communicating groove 72 (fixed-side passage part) is formed in the lower surface (i.e., a thrust surface) of the outer edge part 43 of the fixed scroll 40. The inflow end of the fixed-side communicating groove 72 opens to the inner peripheral surface of the outer edge part 43, and the outflow end of the fixed-side communicating groove 72 is formed in a position intermittently connected to the movable-side vertical hole 71. More specifically, an inflow groove part 72*a*, an intermediate groove part 72*b*, and an outflow groove part 72*c* of the fixed-side communicating groove 72 are formed integrally and continuously. The inflow groove part 72*a* extends radially outward from the inner peripheral surface of the outer edge part 43. The intermediate groove part 72*b* extends in the circumferential direction so as to be bent from the radially outward end part of the inflow groove part 72*a*. The outflow groove part 72*c* is bent radially inward from the outflow side of the intermediate groove part 72*b*, and the outflow end part of the outflow groove part 72*c* overlaps the turn trajectory of the movable-side vertical hole 71.

In the introduction mechanism 70, the fixed-side communicating groove 72 and the movable-side vertical hole 71 intermittently communicate due to the orbiting operation of the movable scroll 35. In the introduction mechanism 70, an introduction path is configured such that communication between the fixed-side communicating groove 72 and the movable-side vertical hole 71 enables communication between the intermediate-pressure-side back pressure chamber 56 and the outermost-peripheral side of the compression chamber 31. The introduction mechanism 70 supplies the intermediate-pressure refrigerant being compressed in the compression chamber 31 to the intermediate-pressure-side back pressure chamber 56 over a "first period" through the introduction paths 71, 72.

(2-4-4) Auxiliary Introduction Mechanism

The auxiliary introduction mechanism 80 has a fixed-side communicating hole 81 that is an auxiliary introduction path, and a check valve 82 for opening and closing the fixed-side communicating hole 81 (see FIG. 2).

The fixed-side communicating hole 81 is formed in a peripheral wall part 43*a* of the outer edge part 43 of the fixed scroll 40, the peripheral wall part 43*a* being formed near the fixed-side panel part 41 (see FIG. 5). The fixed-side communicating hole 81 passes radially through the peripheral wall part 43*a*, the upper space 15 and the outermost-peripheral side of the compression chamber 31 communicating via the fixed-side communicating hole 81.

In the inner wall part of the outer edge part 43 of the fixed scroll 40, the inflow end of the fixed-side communicating hole 81 is positioned closer to the intake port 34 compared with the inflow end of the fixed-side communicating groove 72. Specifically, the fixed-side communicating hole 81 constitutes an introduction path that is on the low-pressure side (intake side) compared with the fixed-side communicating groove 72.

The check valve 82 is provided to the outflow part of the fixed-side communicating hole 81. The check valve 82 allows the refrigerant to flow from the compression chamber 31 to the upper space 15, and inhibits the refrigerant from flowing from the upper space 15 to the compression chamber 31. The check valve 82 is configured from a lead valve that is opened in accordance with the pressure difference between the compression chamber 31 and the upper space 15.

In the auxiliary introduction mechanism 80, when the pressure in the intermediate-pressure-side back pressure chamber 56, and thus in the upper space 15, is reduced and the pressure difference between the compression chamber 31 and the upper space 15 exceeds a prescribed pressure, the check valve 82 is opened. As a result, the refrigerant in the compression chamber 31 is introduced into the intermediate-pressure-side back pressure chamber 56 via the fixed-side communicating hole 81 and the upper space 15. The auxiliary introduction mechanism 80 is configured to supply the refrigerant in the compression chamber 31 to the intermediate-pressure-side back pressure chamber 56 over a "second period" that includes a timing earlier than the period (first period) when the introduction mechanism 70 supplies the refrigerant to the intermediate-pressure-side back pressure chamber 56.

(3) Operation of the Scroll-Type Compressor (3-1) Operation During Normal Operating In a state in which the compressor 10 is operating normally, the intermediate-pressure-side back pressure chamber 56 is maintained at a preferred back pressure. In this case, the compressor 10 performs the operations described below.

First, power is distributed to the electric motor 20 of the compressor 10 so that the movable scroll 35 rotates eccentrically about the axis of the drive shaft 23. The volume of the compression chamber 31 is thereby changed periodically. Next, as the movable scroll 35 orbits, the fluid chamber is closed and the compression chamber 31 is divided (see FIG. 3). Before the compression chamber 31 is divided, the refrigerant is taken into the outermost-peripheral side fluid chamber via the intake port 34. After the compression chamber 31 is divided, the refrigerant is introduced from the injection port 45.

Figure 6:
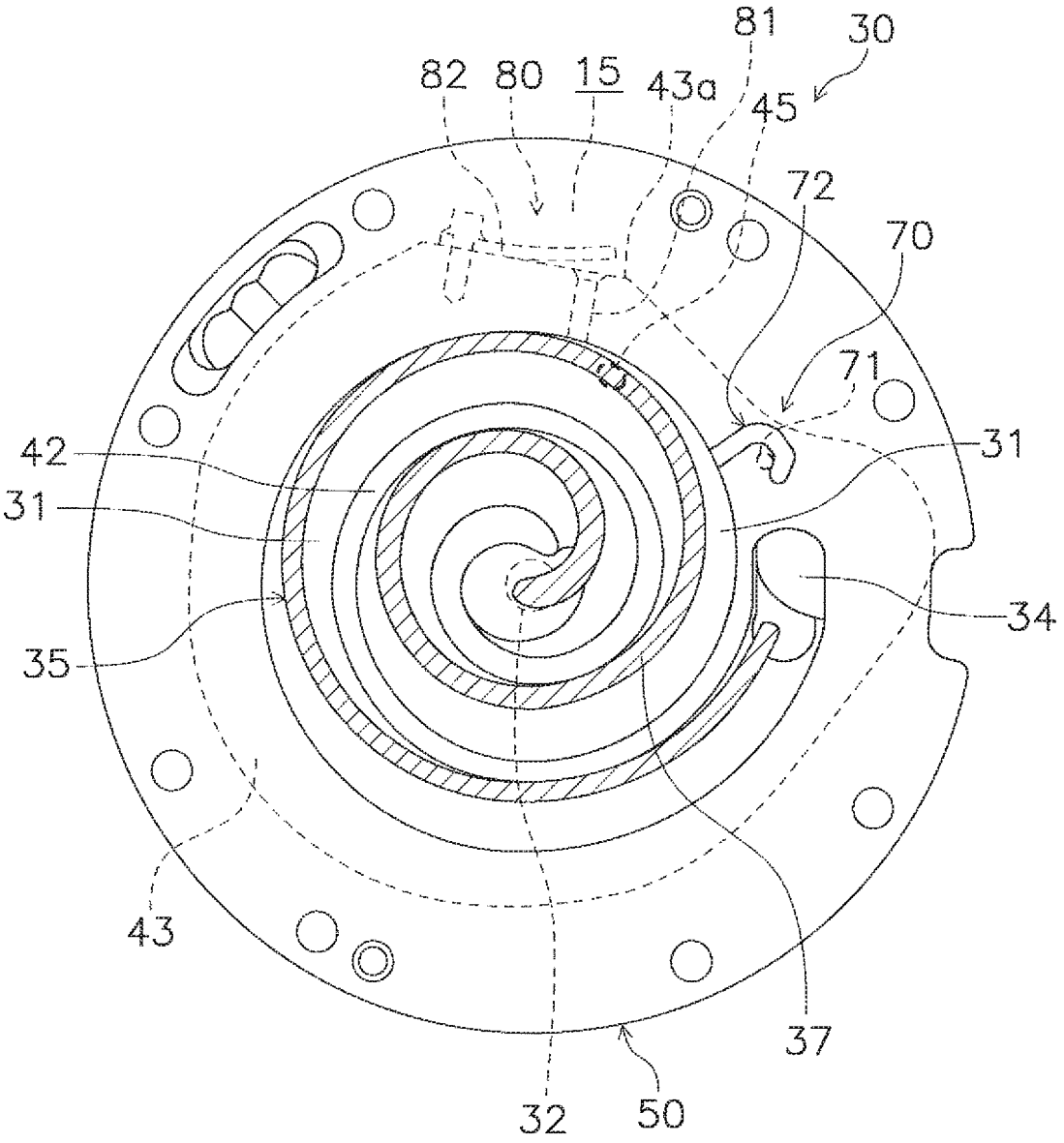
FIG. 6 is a diagram illustrating a horizontal cross-section in which a fixed scroll 40 is viewed from below (rotation angle θ2)

Next, as the movable scroll 35 orbits, the movable-side vertical hole 71 and the fixed-side communicating groove 72 communicate, as shown in FIG. 6. The refrigerant being compressed in the compression chamber 31 is thereby introduced into the intermediate-pressure-side back pressure chamber 56 through the fixed-side communicating groove 72 and the movable-side vertical hole 71 in the stated order.

Figure 7:
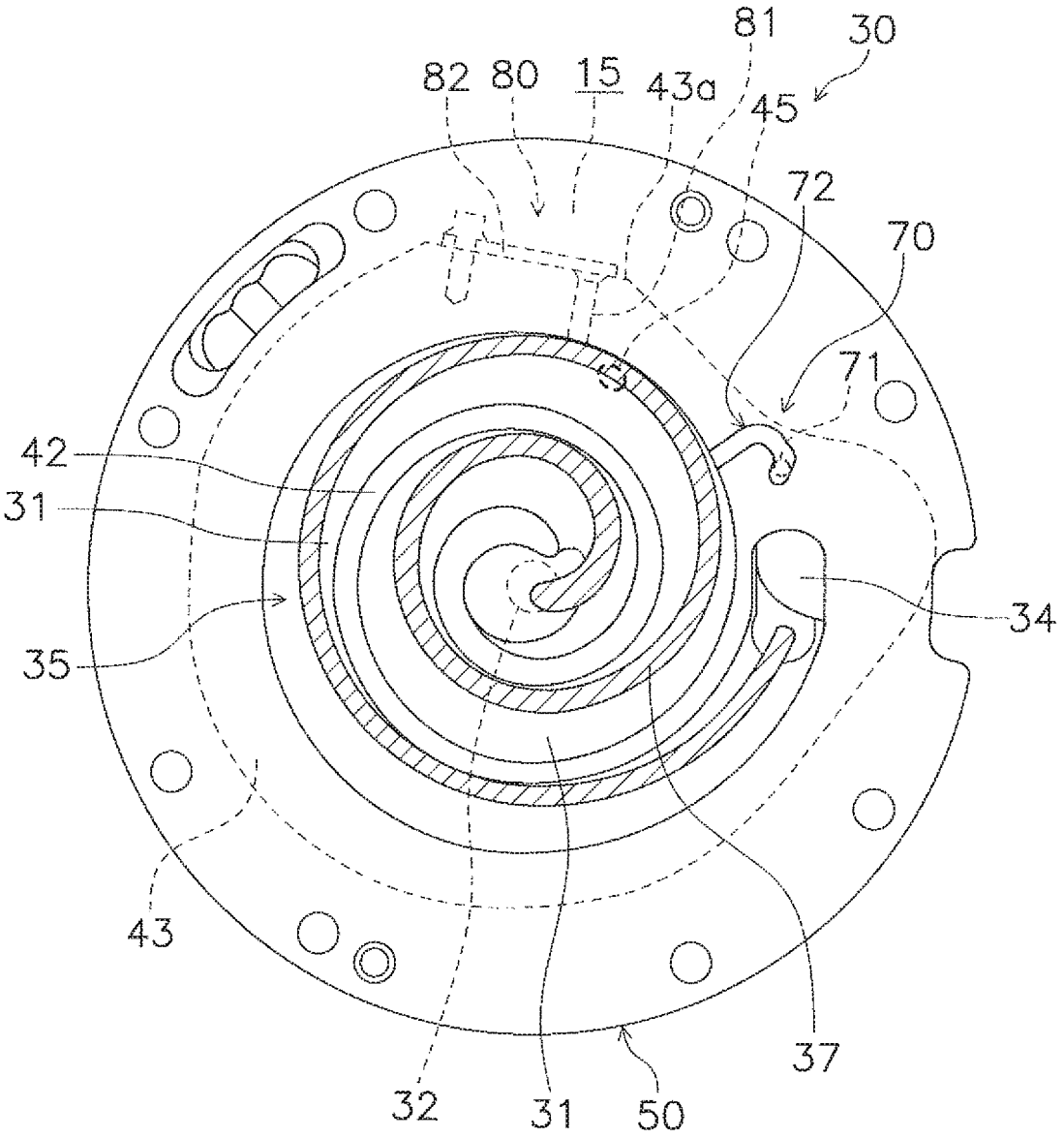
FIG. 7 is a diagram illustrating a horizontal cross-section in which the fixed scroll 40 is viewed from below (rotation angle θ4)

When the movable scroll 35 orbits further from this state, the opening area of the movable-side vertical hole 71 with respect to the fixed-side communicating groove 72 in the introduction mechanism 70 is maximized (see FIG. 7). As a result, the intermediate-pressure-side back pressure chamber 56 is maintained at a desired pressure (also referred to as "target back pressure"). When the back pressure in the intermediate-pressure-side back pressure chamber 56 is the target back pressure, pressing force is applied to the movable-side panel part 36 of the movable scroll 35. The movable scroll 35 is thereby pressed toward the fixed scroll 40 side, suppressing overturning of the movable scroll 35.

Figure 8:
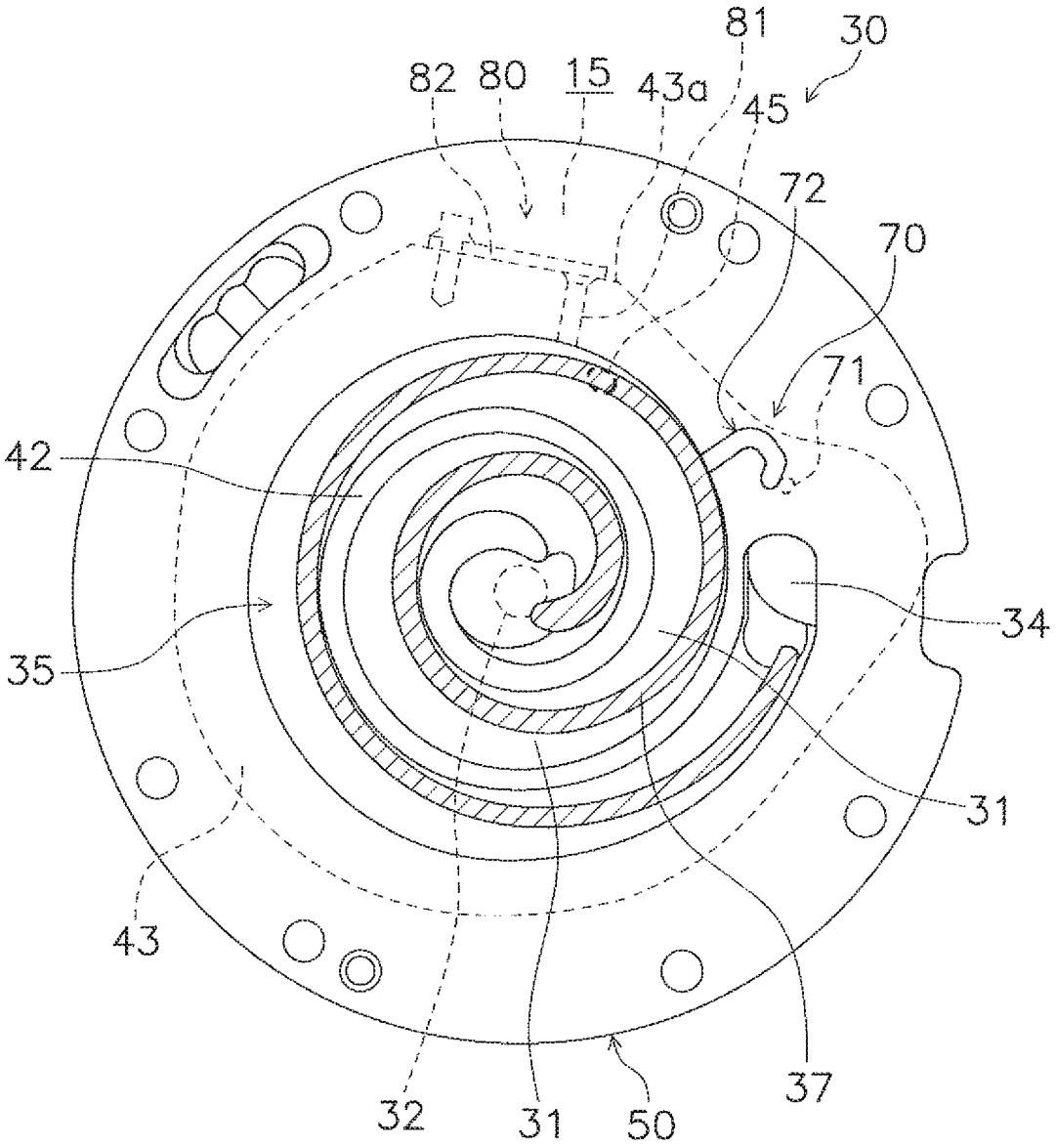
FIG. 8 is a diagram illustrating a horizontal cross-section in which the fixed scroll 40 is viewed from below (rotation angle θ5)

Next, when the movable scroll 35 orbits further from the state shown in FIG. 7, the fixed-side communicating groove 72 and the movable-side vertical hole 71 are blocked by each other (see FIG. 8). As a result, the operation for introducing the refrigerant into the intermediate-pressure-side back pressure chamber 56 by the introduction mechanism 70 is stopped.

When the movable scroll 35 orbits further form this state, the compression chamber 31 near the center communicates with the discharge port 32. As a result, the refrigerant compressed in the compression chamber 31 is discharged from the discharge port 32 in to the discharge chamber 46. The refrigerant flows out to the discharge tube 19 via the lower space 16 of the casing 11. The refrigerant that has flowed out is then used in the refrigeration cycle.

FIGS. 3 and 6 show the operation of the auxiliary introduction mechanism 80; however, when the compressor 10 is operating normally, the auxiliary introduction mechanism 80 does not operate. This is because when the intermediate-pressure-side back pressure chamber 56 is maintained at the target pressure as described above, the check valve 82 of the fixed-side communicating hole 81 is in a closed state. Specifically, during such normal operating, the refrigerant in the compression chamber 31 is not supplied to the upper space 15 through the auxiliary introduction path (fixed-side communicating hole 81).

(3-2) Operation when Pressure in Intermediate-Pressure-Side Back Pressure Chamber is Not Desired Back Pressure (3-2-1)

Cases when the intermediate-pressure-side back pressure chamber 56 does not have the desired back pressure are, for example, in the situation during startup of the compressor 10, during transitional operations, and during performance of the intermediate injection. When the intermediate injection is performed by the compressor 10, the movable scroll 35 could be overturned due to the pressure in the compression chamber 31 being increased by injection. A problem is presented in conventional compressors in that once the movable scroll 35 is overturned, the overturning of the movable scroll 35 cannot be quickly reversed.

Specifically, if, e.g., the movable scroll 35 is overturned, a comparatively wide gap could be formed in the thrust surface between the movable-side panel part 36 of the movable scroll 35 and the outer edge part 43 of the fixed scroll 40. Under these circumstances, the intermediate-pressure refrigerant in the intermediate-pressure-side back pressure chamber 56 could leak through the gap to the intake side (low-pressure side) of the compression chamber 31. As a result, the pressure Pu in the intermediate-pressure-side back pressure chamber 56 is significantly less than the initial target pressure Po, as shown in FIG. 9, and it becomes impossible to impart the desired pressing force to the movable scroll 35.

Additionally, if the movable scroll 35 is overturned, a comparatively wide gap could be formed between the distal end of the fixed-side lap 42 and the movable-side panel part 36, or between the distal end of the movable-side lap 37 and the fixed-side panel part 41. The comparatively high-pressure refrigerant near the discharge port 32 could thereby leak through such gaps to the compression chamber 31 near the intake port, creating excess pressure as the refrigerant is re-compressed. As a result, the internal pressure in the compression chamber increases overall to a greater extent than during normal operating, as shown by dashed lines in FIG. 9, and separating force in the movable scroll 35 increases due to the gas load.

When the pressing force applied to the movable scroll 35 is insufficient and the separating force applied to the movable scroll 35 is excessive, it becomes impossible for the overturned movable scroll 35 to return to the original state. As a result, the reliability of the compressor 10 deteriorates. In the present embodiment, a configuration is adopted such that the auxiliary introduction mechanism 80 is operated, whereby overturning of the movable scroll 35 is suppressed even when the intermediate injection is performed.

Figure 9:
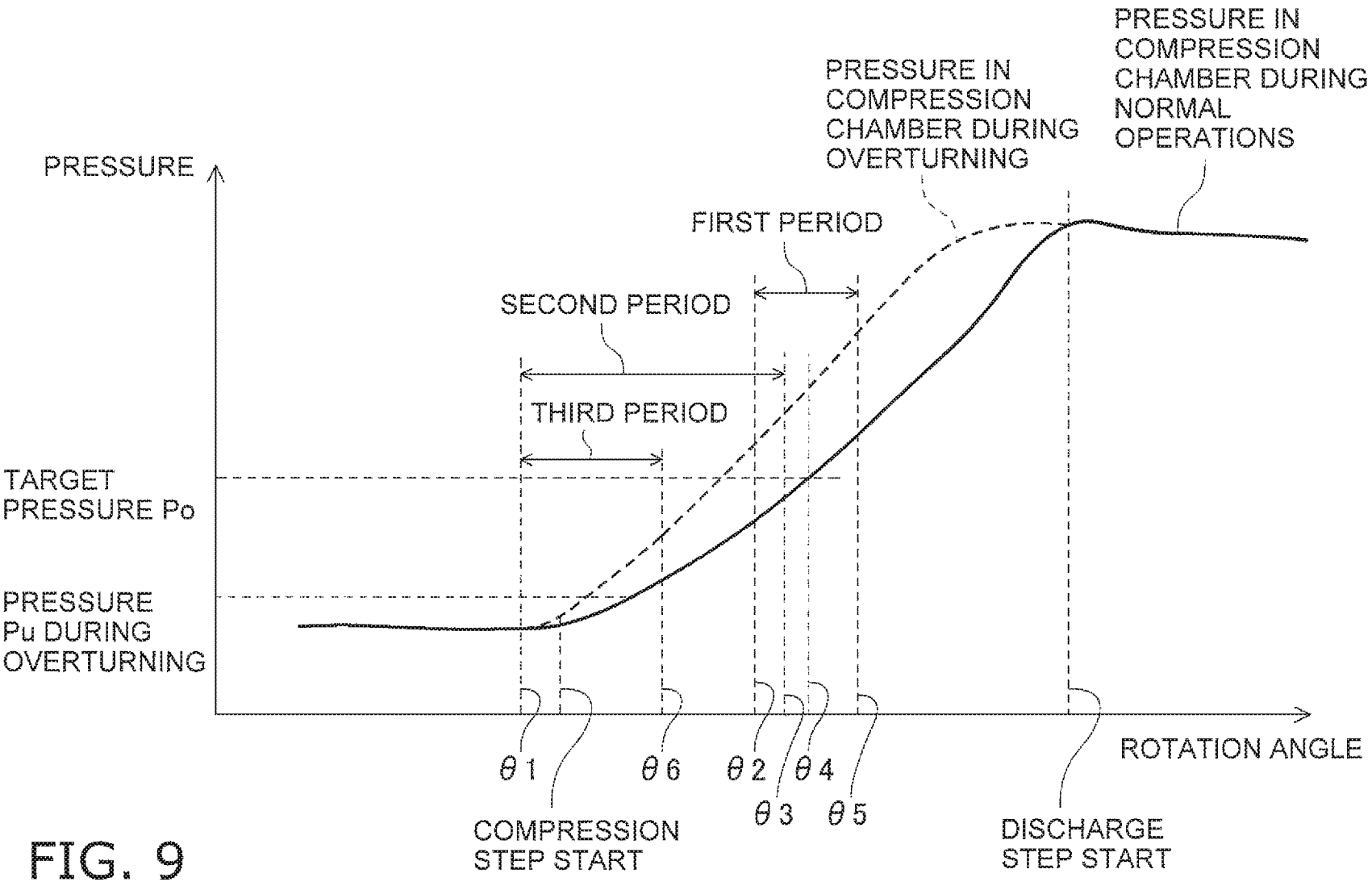
FIG. 9 is a graph illustrating the change in the internal pressure of a compression chamber 31 of a compression mechanism 30.

The fixed-side communicating hole 81 according to the present embodiment is formed at a position so as to be capable of opening to the outermost-peripheral side fluid chamber over the "second period" shown in FIG. 9. Specifically, the inflow opening of the fixed-side communicating hole 81 is disposed so as to approach the fluid chamber inside the compression mechanism 30 over a range of rotation angles θ1-θ3 of the movable scroll 35. The rotation angle θ1 is a rotation angle slightly earlier than the rotation angle that corresponds to the timing at which the compression stroke of the outermost-peripheral side compression chamber 31 starts. The rotation angle θ3 is a rotation angle later than the timing (rotation angle θ2 shown in FIG. 6) at which the communication between the compression chamber 31 and the intermediate-pressure-side back pressure chamber 56 starts due to the introduction mechanism 70 described above. The rotation angle θ3 is also slightly earlier than the timing (rotation angle θ4 shown in FIG. 7) at which the opening area of the movable-side vertical hole 71 with respect to the fixed-side communicating groove 72 is maximized.

The injection port 45 according to the present embodiment is formed at a position so as to be capable of opening to the outermost-peripheral side fluid chamber over the "third period" shown in FIG. 9. Specifically, the injection port 45, which is the outflow port of the injection passage 44, is disposed so as to approach the fluid chamber inside the compression mechanism 30 over a range of rotation angles θ1-θ6 of the movable scroll 35. The rotation angle θ6 is a rotation angle earlier than the rotation angle θ2 described above. Specifically, the injection port 45 is formed such that the third period is included in the second period. Additionally, the injection port is formed such that the third period does not overlap the first period.

(3-2-2)

When the intermediate injection is performed in such a scroll-type compressor 10, the injection port 45 is opened over the third period, which corresponds to the rotation angles θ1-θ6 of the movable scroll 35, and the intermediate-pressure refrigerant flows into the compression chamber 31. During performance of the intermediate injection, there are cases when the pressure in the compression chamber 31 is greater than the target back pressure. In the cases, the check valve 82 is opened, and the refrigerant being compressed in the compression chamber 31 is supplied to the intermediate-pressure-side back pressure chamber 56 via the fixed-side communicating hole 81 and the upper space 15 over the second period (see FIG. 3). As a result, the pressure in the intermediate-pressure-side back pressure chamber 56 quickly increases.

Then, when the movable scroll 35 reaches the rotation angle θ2, the refrigerant being compressed in the compression chamber 31 is supplied to the intermediate-pressure-side back pressure chamber 56 by the introduction mechanism 70. Thus, in the present embodiment, when the intermediate injection is performed, the refrigerant in the compression chamber 31 is supplied to the intermediate-pressure-side back pressure chamber 56 over the second period and the first period. Therefore, the pressure in the intermediate-pressure-side back pressure chamber 56 can quickly increase.

Moreover, in the present embodiment, part of the second period overlaps part of the first period, and the timing at which the second period ends is approximately immediately before the rotation angle θ4, as shown in FIG. 6. Therefore, the comparatively high-pressure refrigerant directed from the auxiliary introduction path 81 to the intermediate-pressure-side back pressure chamber 56 can be introduced over a long period of time. As a result, the pressure in the intermediate-pressure-side back pressure chamber 56 can even more quickly increase.

(4) Characteristics (4-1)

The scroll-type compressor 10 according to the present embodiment includes the fixed scroll 40, the movable scroll 35, the housing 50, the injection passage 44, and the auxiliary introduction mechanism (relief mechanism) 80. The movable scroll 35 is coupled with the fixed scroll 40 to form the compression chamber 31. The housing 50 forms the intermediate-pressure-side back pressure chamber 56 in which the refrigerant for applying back pressure to the movable scroll 35 is accumulated. The injection passage 44 is provided to the fixed scroll 40, the external injection pipe 62 and the compression chamber 31 communicating via the injection passage 44. The auxiliary introduction mechanism 80 is provided to the fixed scroll 40, the compression chamber 31 and the intermediate-pressure-side back pressure chamber 56 communicating via the auxiliary introduction mechanism 80 when the injection pressure, which is the pressure of the refrigerant flowing from the injection passage 44 to the compression chamber 31, is greater than the pressure in the back pressure chamber.

Because the scroll-type compressor 10 is provided with the configuration described above, the compression chamber 31 and the intermediate-pressure-side back pressure chamber 56 communicate via the auxiliary introduction mechanism 80 when the injection pressure is greater than the pressure in the back pressure chamber, even when the refrigerant is injected into the compression chamber 31. This makes it possible to quickly increase the pressure in the intermediate-pressure-side back pressure chamber 56, and to suppress overturning of the movable scroll 35.

In the scroll-type compressor 10, the compression chamber 31 and the intermediate-pressure-side back pressure chamber 56 communicate via the auxiliary introduction mechanism 80, making it possible to quickly increase the pressure in the intermediate-pressure-side back pressure chamber 56, even in the event that the overturning of the movable scroll has occurred. Therefore, the overturning of the movable scroll 35 can be quickly reversed irrespective of whether the refrigerant is injected into the compression chamber 31.

Furthermore, in the scroll-type compressor 10 the auxiliary introduction mechanism 80 prevents the communication between the compression chamber 31 and the intermediate-pressure-side back pressure chamber 56 when the injection pressure is not higher than the pressure in the back pressure chamber, therefore making it possible to suppress reductions in compression performance.

(4-2)

In the scroll-type compressor 10, the auxiliary introduction mechanism 80 is provided with the fixed-side communicating hole (relief passage part) 81 and the check valve 82. The fixed-side communicating hole 81 is provided to the fixed scroll 40, the compression chamber 31 and the intermediate-pressure-side back pressure chamber 56 communicating via the fixed-side communicating hole 81. The check valve 82 is configured to respond to the fluid in the fixed-side communicating hole 81.

Because the scroll-type compressor 10 is provided with the configuration described above, the check valve 82 prevents the communication between the compression chamber 31 and the intermediate-pressure-side back pressure chamber 56 when the injection pressure is lower than the pressure in the back pressure chamber. This makes it possible to prevent a reduction in the pressure in the intermediate-pressure-side back pressure chamber 56.

(4-3)

In the scroll-type compressor 10, the fixed scroll 40 includes the fixed-side panel part 41 and the fixed-side outer edge part 43. The injection passage 44 is provided to the fixed-side panel part 41. The fixed-side communicating hole 81 is provided to the fixed-side outer edge part 43. This configuration makes it possible to introduce refrigerant gas into the intermediate-pressure-side compression chamber 31 in accordance with the orbiting operation of the movable scroll 35.

(4-4)

The scroll-type compressor 10 includes the introduction mechanism 70 for introducing the refrigerant in the compression chamber 31 into the intermediate-pressure-side back pressure chamber 56 over the first period when the pressure in the compression chamber is higher than the pressure in the back pressure chamber. The auxiliary introduction mechanism 80 introduces the refrigerant in the compression chamber 31 into the intermediate-pressure-side back pressure chamber 56 over the second period that includes a timing earlier than the first period.

Because the scroll-type compressor 10 introduces the refrigerant into the intermediate-pressure-side back pressure chamber 56 over the second period at a timing earlier than the first period, the pressure in the intermediate-pressure-side back pressure chamber 56 can be quickly increased via the auxiliary introduction mechanism 80.

(4-5)

Furthermore, the scroll-type compressor 10 is configured such that part of the second period overlaps part of the first period. This makes it possible for the scroll-type compressor 10 to supply comparatively high-pressure fluid to the back pressure chamber over a long period of time. As a result, the overturning of the movable scroll can be fluffier suppressed.

(4-6)

The scroll-type compressor 10 furthermore is provided with an injection mechanism for introducing the refrigerant from the injection passage 44 into the compression chamber 31 over the third period. A configuration is adopted such that the third period does not overlap the first period. Because the third period, in which the refrigerant is introduced from the injection passage 44 into the compression chamber 31, does not overlap the first period, the intermediate-pressure-side back pressure chamber 56 can be stabilized at a desired pressure.

(4-7)

The scroll-type compressor 10 is configured such that the third period is included in the second period. This makes it possible to quickly increase the pressure in the intermediate-pressure-side back pressure chamber 56 from a point in time when the refrigerant has been introduced from the injection passage 44 into the compression chamber 31, even when there is a risk of overturning in the scroll-type compressor 10.

(4-8)

In the scroll-type compressor 10, the introduction mechanism 70 is provided with the fixed-side communicating groove (fixed-side passage part) 72 and the movable-side vertical hole (movable-side passage part) 71. The fixed-side communicating groove 72 is formed in the fixed scroll 40, and communicates from the compression chamber 31 to the outflow end (opening end). The movable-side vertical hole 71 is formed in the movable scroll 35, the compression chamber 31 and the intermediate-pressure-side back pressure chamber 56 communicating, by connection of the fixed-side communicating groove 72, in accordance with the orbiting operation of the movable scroll 35. Because the scroll-type compressor 10 is provided with the configuration described above, the refrigerant can be easily introduced into the intermediate-pressure-side back pressure chamber 56.

(4-9)

In the scroll-type compressor 10, the introduction mechanism 70 is configured such that the second period ends before the point in time when a connection area of the fixed-side communicating groove 72 and the movable-side vertical hole 71 is maximized.

Therefore, in the scroll-type compressor 10, the introduction of refrigerant into the intermediate-pressure-side back pressure chamber 56 by the auxiliary introduction mechanism 80 ends earlier than the introduction of refrigerant into the intermediate-pressure-side back pressure chamber 56 by the introduction mechanism 70; therefore, the intermediate-pressure-side back pressure chamber 56 can be stabilized at a desired pressure.

(4-10)

In the scroll-type compressor 10, the auxiliary introduction mechanism 80 is provided on the low-pressure side of the compression chamber 31 compared with the introduction mechanism 70. Because the scroll-type compressor 10 is provided with the configuration described above, the pressure in the intermediate-pressure-side back pressure chamber 56 can be set to a desired pressure during normal operation of the compressor.

(5) Modifications

Modifications of the above embodiments are presented below. A plurality of modifications may be combined, insofar as there are no inconsistencies.

(5-1)

In the embodiment described above, part of the period (second period) in which the refrigerant is supplied to the intermediate-pressure-side back pressure chamber 56 by the auxiliary introduction mechanism 80 overlaps part of the period (first period) in which the refrigerant is supplied to the intermediate-pressure-side back pressure chamber 56 by the introduction mechanism 70. However, these two periods do not necessarily need to overlap; the first period may be set after the end of the second period.

Additionally, in the auxiliary introduction mechanism 80 of the embodiment described above, the auxiliary introduction path 81 is formed in the peripheral wall part 43*a* of the outer edge part 43 of the fixed scroll 40. However, a configuration may be adopted such that a through-hole is formed in the fixed-side panel part 41 of the fixed scroll 40, and the auxiliary introduction path 81 is formed therein. In this case, the check valve 82 is attached to the upper side of the fixed-side panel part 41 and is configured to open and close the upper end part of the auxiliary introduction path 81.

(5-2)

In the embodiment described above, the length of the injection passage 44 may be set so as to attenuate pulsation at 70-1,400 Hz. This makes it possible to enhance the effect of attenuating pulsation of the refrigerant.

(5-3)

Figure 10:
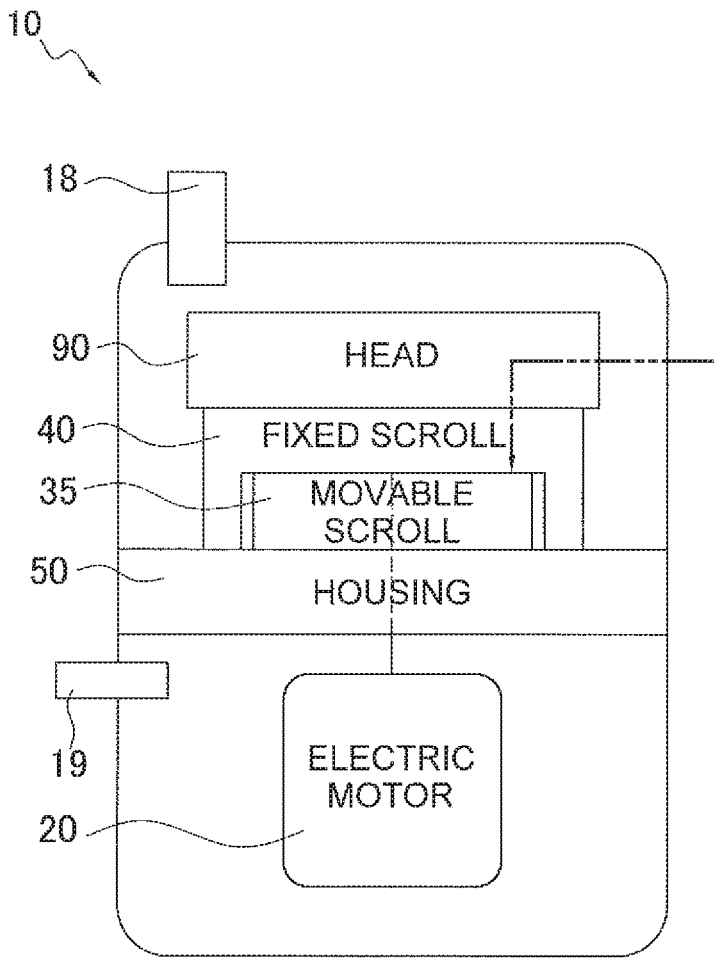
FIG. 10 is a schematic block diagram illustrating the scroll-type compressor 10.
Figure 11:
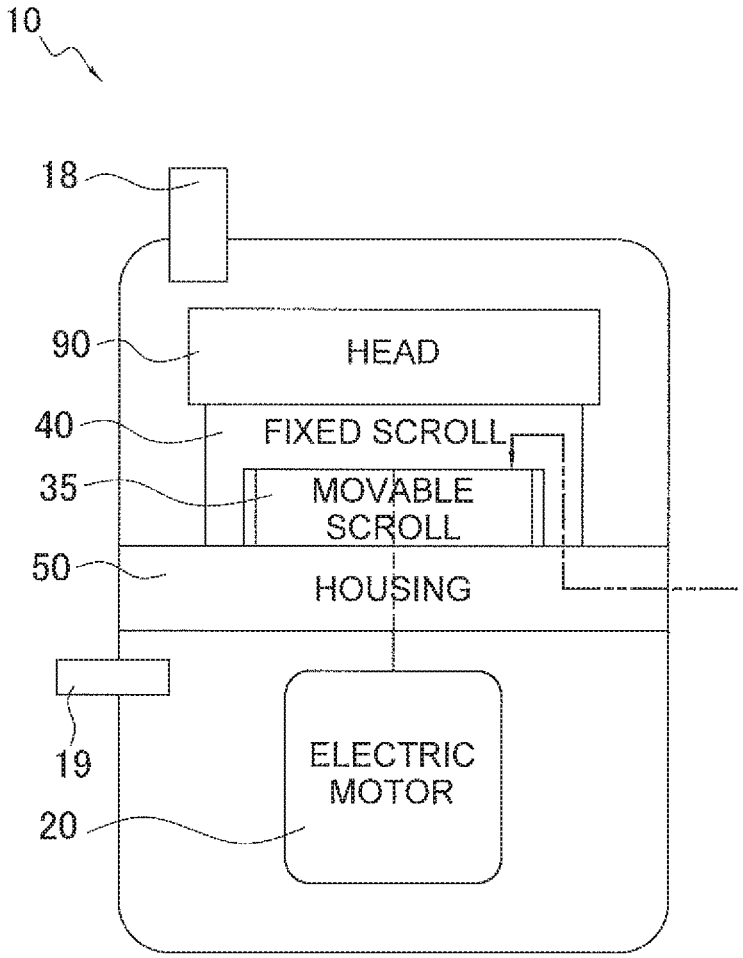
FIG. 11 is a schematic block diagram illustrating the scroll-type compressor 10.

In the embodiment described above, the injection passage may be configured as a pathway such as shown in FIGS. 10 and 11. FIGS. 10 and 11 are schematic block diagrams illustrating the scroll-type compressor 10 of FIG. 2. In FIGS. 10 and 11, the pathway shown by chain double-dashed lines indicates that the injection pipe 62 and the injection passage 44 of FIG. 2 are configured as a single injection pathway.

Specifically, the injection pathway may be provided to the fixed scroll 40 and the head member 90, as shown in FIG. 10. Alternatively, the injection pathway may be provided to the housing 50 and the fixed scroll 40, as shown in FIG. 11. Essentially, the injection pathway can be set, as appropriate, in accordance with the application for which it is used.

INDUSTRIAL APPLICABILITY

The present invention pertains to a scroll-type compressor, and in particular is useful as a measure against overturning of a compression-chamber-forming member.

REFERENCE SIGNS LIST

10 Scroll-type compressor
31 Compression chamber
35 Movable scroll (compression-chamber-forming member)
40 Fixed scroll (compression-chamber-forming member)
41 Fixed-side panel part
43 Outer edge part (fixed-side outer edge part)
44 Injection passage
45 Injection port
50 Housing
56 Intermediate-pressure-side back pressure chamber (back pressure chamber)
62 Injection pipe
70 Introduction mechanism
71 Movable-side vertical hole (movable-side passage part)
72 Fixed-side communicating groove (fixed-side passage part)
80 Auxiliary introduction mechanism (relief mechanism)
81 Fixed-side communicating hole (relief passage part)
82 Check valve
90 Head member

CITATION LIST

Patent Literature

[Patent Document 1] Japanese Laid-open Patent Application No. H11-10950
[Patent Literature 2] Japanese Laid-open Patent Publication No. 2012-117519

What is claimed is:

1. A scroll-type compressor, comprising:

a compression-chamber-forming member having a movable scroll and a fixed scroll cooperating to form a compression chamber;

a shaft arranged to drive the movable scroll relative to the fixed scroll to compress refrigerant in the compression chamber;

a housing forming a back pressure chamber, refrigerant for applying back pressure to the compression-chamber-forming member being accumulated in the back pressure chamber;

an injection passage part formed in at least one of the compression-chamber-forming member and other surrounding members, and the injection passage part being linked to the compression chamber; and a relief mechanism provided to the compression-chamber-forming member, the relief mechanism being configured to establish a communication between the compression chamber and the back pressure chamber communicating when injection pressure, which is the pressure of the refrigerant flowing from the injection passage part into the compression chamber, is higher than the pressure in the back pressure chamber, the relief mechanism including a relief passage part formed radially through a peripheral wall of an outer edge part of the fixed scroll, the relief passage part being configured to establish a communication between the compression chamber and the back pressure chamber, and a check valve associated with the relief passage part, the check valve being opened when the pressure in the back pressure chamber is reduced and the pressure difference between the compression chamber and the back pressure chamber exceeds a prescribed pressure.

2. The scroll-type compressor according to claim 1, wherein:

the injection passage part is provided to the fixed scroll of the compression-chamber-forming member, and the relief mechanism is provided to the fixed scroll of the compression-chamber-forming member.

3. The scroll-type compressor according to claim 2, wherein the fixed scroll includes a fixed-side panel part and the outer edge part, and the injection passage part is provided to at least the fixed-side panel part.

4. The scroll-type compressor according to claim 2, further comprising an introduction mechanism arranged to introduce the refrigerant in the compression chamber into the back pressure chamber over a first period, the relief mechanism introducing the refrigerant in the compression chamber into the back pressure chamber over a second period, which includes a timing earlier than the first period, when the pressure in the compression chamber is higher than the pressure in the back pressure chamber.

5. The scroll-type compressor according to claim 4, wherein part of the second period overlaps part of the first period.

6. The scroll-type compressor according to claim 4, further comprising an injection mechanism arranged to introduce the refrigerant from the injection passage part into the compression chamber over a third period, the third period does not overlap the first period.

7. The scroll-type compressor according to claim 6, wherein the third period is included in the second period.

8. The scroll-type compressor according to claim 4, wherein the introduction mechanism includes a fixed-side passage part formed in the fixed scroll, the fixed-side passage part communicating the compression chamber with an opening end, and a movable-side passage part formed in the movable scroll, the movable-side passage part being configured to establish a communication between the compression chamber and the back pressure chamber, by connection to the fixed-side passage part, in accordance with an orbiting operation of the movable scroll.

9. The scroll-type compressor according to claim 8, wherein the introduction mechanism is configured such that the second period ends before a point in time when a connection area of the fixed-side passage part and the movable-side passage part is maximized.

10. The scroll-type compressor according to claim 4, wherein the relief mechanism is provided on a low-pressure side of the compression chamber as compared with the introduction mechanism.

11. The scroll-type compressor according to claim 1, wherein the fixed scroll includes a fixed-side panel part and the outer edge part, and the injection passage part is provided to at least the fixed-side panel part.

12. The scroll-type compressor according to claim 1, further comprising an introduction mechanism arranged to introduce the refrigerant in the compression chamber into the back pressure chamber over a first period, the relief mechanism introducing the refrigerant in the compression chamber into the back pressure chamber over a second period, which includes a timing earlier than the first period, when the pressure in the compression chamber is higher than the pressure in the back pressure chamber.

13. The scroll-type compressor according to claim 12, wherein part of the second period overlaps part of the first period.

14. The scroll-type compressor according to claim 12, further comprising an injection mechanism arranged to introduce the refrigerant from the injection passage part into the compression chamber over a third period, the third period does not overlap the first period.

15. The scroll-type compressor according to claim 14, wherein the third period is included in the second period.

16. The scroll-type compressor according to claim 12, wherein the introduction mechanism includes a fixed-side passage part formed in the fixed scroll, the fixed-side passage part communicating the compression chamber with an opening end, and a movable-side passage part formed in the movable scroll, the movable-side passage part being configured to establish a communication between the compression chamber and the back pressure chamber, by connection to the fixed-side passage part, in accordance with an orbiting operation of the movable scroll.

17. The scroll-type compressor according to claim 16, wherein the introduction mechanism is configured such that the second period ends before a point in time when a connection area of the fixed-side passage part and the movable-side passage part is maximized.

18. The scroll-type compressor according to claim 12, wherein the relief mechanism is provided on a low-pressure side of the compression chamber as compared with the introduction mechanism.

* * * * *